US008955435B2

(12) United States Patent
Sezaki et al.

(10) Patent No.: US 8,955,435 B2
(45) Date of Patent: Feb. 17, 2015

(54) METHOD OF PRODUCING PRINT PRODUCT AND PRINT PRODUCT PRODUCTION DEVICE

(75) Inventors: Hiroki Sezaki, Zama (JP); Hisashi Goto, Ebina (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 363 days.

(21) Appl. No.: 13/280,999

(22) Filed: Oct. 25, 2011

(65) Prior Publication Data

US 2012/0122647 A1 May 17, 2012

(30) Foreign Application Priority Data

Nov. 11, 2010 (JP) ..... 2010-253130

(51) Int. Cl.
*B41F 13/56* (2006.01)
*B41J 3/60* (2006.01)
*B41J 11/66* (2006.01)

(52) U.S. Cl.
CPC ... *B41J 3/60* (2013.01); *B41J 11/66* (2013.01)
USPC ..... 101/227; 270/21.1

(58) Field of Classification Search
CPC ..... B41F 13/54; B41F 13/56; B41F 13/58; B41F 13/60; B41F 13/62; B41J 3/30; B41J 3/60; B41J 15/00; B41J 15/005; B41J 15/02; B41J 15/04; B65H 45/04; B65H 45/06; B65H 45/09; B65H 45/162
USPC ..... 101/226, 227, 484, 485; 270/5.01, 5.02, 270/5.03, 8, 20.1, 21.1
See application file for complete search history.

(56) References Cited

U.S. PATENT DOCUMENTS

| | | | | |
|---|---|---|---|---|
| 4,720,091 | A | 1/1988 | Kobler | |
| 5,045,127 | A * | 9/1991 | Dershem et al. | 148/23 |
| 6,821,038 | B2 * | 11/2004 | Izawa | 400/621.1 |
| 7,631,857 | B2 * | 12/2009 | Hunkeler et al. | 270/5.03 |
| 8,100,053 | B2 * | 1/2012 | Grunder et al. | 101/226 |
| 8,342,675 | B2 * | 1/2013 | Motojima et al. | 347/104 |
| 2004/0221749 | A1 | 11/2004 | Fujinuma et al. | |
| 2009/0080960 | A1 * | 3/2009 | Yamamoto | 400/621 |
| 2011/0050767 | A1 * | 3/2011 | Knauer | 347/9 |

FOREIGN PATENT DOCUMENTS

| | | |
|---|---|---|
| CN | 100581966 C | 1/2010 |
| JP | 62-51567 | 3/1987 |
| JP | 11-106089 | 4/1999 |
| JP | 2002-193545 | 7/2002 |
| JP | 2003-341927 | 12/2003 |
| JP | 2004-330660 | 11/2004 |
| JP | 2007-015859 | 1/2007 |
| JP | 2007-076923 | 3/2007 |
| JP | 2009-234750 | 10/2009 |
| JP | 2009-269735 | 11/2009 |
| JP | 2010-189165 | 9/2010 |

* cited by examiner

*Primary Examiner* — Ren Yan
(74) *Attorney, Agent, or Firm* — Clark Hill PLC

(57) ABSTRACT

A method of producing a print product comprises: performing digital printing of each surface of the print product, sequentially and repeatedly, on a continuous paper; forming a section by cutting the printing-completed continuous paper into a paper sheet and folding the paper sheet in two; forming a section block by at least one of sections; and folding the section block in two.

5 Claims, 4 Drawing Sheets

METHOD OF PRODUCING PRINT PRODUCT AND PRINT PRODUCT PRODUCTION DEVICE

CROSS-REFERENCE TO RELATED APPLICATIONS

The present application relates to subject matter contained in Japanese Patent Application No. 2010-253130, filed on Nov. 11, 2010, all of which is expressly incorporated herein by reference in its entirety.

BACKGROUND OF THE INVENTION

1. Field of the Invention

The present invention relates to: a method of producing a print product, for example, a newspaper or the like, the method performing digital printing on a continuous paper, cutting the continuous paper into paper sheets, and folding and gathering the paper sheets after cutting to produce the print product; and a print product production device.

2. Description of the Related Art

Print products represented by newspapers, commercial printed matter, and the like, have fulfilled their mission by using plates to print items of identical content in large quantities, and by these items being transferred or distributed for profit or free of charge.

However, in recent years, in commercial printing, for example, there has been an increasing requirement for print products of individually differing content, such as personalized direct mail or pamphlets directed to customers of limited district, generation, occupation, etc., and for print products produced in extremely small quantities. Similarly, in newspapers as a representative medium of mass communication, there has also been a shift in demand from newspapers covering various fields including politics, economy, literature, sports, hobby, entertainment, etc., to newspapers that match particular tastes of readers, such as a newspaper focusing on topics field by field, a newspaper targeting readers of a limited district, generation, occupation, etc., a newspaper having characters of both of these, etc. Accordingly, a method of producing a print product and a print product production device to deal with these demands are proposed by Patent Documents 1 to 4 identified below. Note that the print product involved in each of Patent Documents 1 to 4 is a newspaper.

A method of producing a print product disclosed in Patent Document 1 includes (1) a receiving element such as a grasping device, a sucker, etc. receiving sheet by sheet, from a conveyor, sheets of paper on which digital printing such as ink jet printing, etc. has been performed or sheets of paper cut out from a continuous paper on which digital printing has been performed, and carrying the sheets sequentially into a collecting station, (2) stacking the sheets one upon another in the collecting station, (3) discharging a stack of a certain number of sheets from the collecting station, (4) continuously carrying a subsequent series of printed sheets one by one into the collecting station from which the stack has been discharged, (5) carrying the stack discharged from the collecting station into a folding station, and (6) folding the stack in the folding station and outputting the stack from the folding station. The steps (1) to (6) are performed sequentially by the respective stations.

A method of producing a print product disclosed in Patent Document 2 is approximately the same as that disclosed in Patent Document 1. To be specific, Patent Document 2 is different from Patent Document 1 in disclosing that after a printed continuous paper is dried, it is divided into two pieces in parallel with the continuity direction, and in disclosing as to the steps (1) and (2) that a delivery fan mechanism which rotates intermittently is provided in the collecting station, and sheets of paper cut out from a continuous paper on which digital printing has been performed are discharged toward the blades of the delivery fan maintained horizontally so that the sheets are stacked, or that sheets of paper cut out from a continuous paper on which digital printing has been performed are sequentially inserted into between respective blades of a delivery fan having many blades arranged in a circumferential direction, and then a stripper shoe lets the sheets of paper fall from between the blades onto a conveyor so that the sheets are stacked.

A method of producing a print product disclosed in Patent Document 3 includes, in an order from an upstream side: a digital printing system which prints on continuous paper; a side edge cutting station which cuts unnecessary side edge portions of the continuous paper; a lengthwise direction cutting station which cuts the continuous paper in its lengthwise direction (in parallel with the continuity direction); a widthwise cutting station which cuts the continuous paper widthwise (orthogonally to the continuity direction) to separate it into sheets of paper; a removing device which removes faulty sheets including a poorly printed portion or a damaged portion, etc from the separated sheets on the process path; a collecting station in which the sheets of paper are stacked; a carrying device which carries the stack of sheets stacked in the collecting station to a widthwise folding station; a widthwise folding station which folds the stack carried by the carrying device in a direction transverse to the carrying direction; a lengthwise direction folding station which folds the stack in the carrying direction; a sewing station which sews the folded stack along the folding edge; a second collecting station into which a signature formed by folding the stack or by folding and sewing the stack is inserted one into another; and a delivery station which delivers a completed print product. By bringing any stations that are unnecessary according to the configuration and format of the print product to be made into a non-operative condition, it is possible to produce various types of print products that are different from one another in the configuration and format, without interrupting the continuous producing process.

By indicating the laid-open publication number of a European Patent, Patent Document 3 suggests, as the collecting station, a rotary cylinder mechanism which is provided with plural pairs of claws arranged in parallel with its shaft center and which allows sheets of paper to be stacked on its outer circumferential surface by the two claws of each pair alternately sandwiching and retaining a sheet between themselves and the outer circumferential surface. Likewise, by indicating the laid open publication number of a European Patent, Patent Document 3 suggests, as either or both of the widthwise folding station and the lengthwise direction folding station, a mechanism which includes at least: a feed surface; a pair of initial folding rollers parallel with the feed surface and having axes parallel with each other; at least one pair of moving rollers having axes orthogonal to the feed surface and provided above the initial folding rollers; and a rectilinear knife which is a folding blade provided in parallel with the axes of the initial folding rollers. This mechanism feeds a stack of sheets, which are horizontally put and fed to the feed surface, into between the pair of initial folding rollers by causing the rectilinear knife to project upward a portion of the stack at which the stack is to be folded, then causes the two initial folding rollers to rotate about their axes while sandwiching therebetween the projected stack of sheets to form an incomplete folding line and at the same time send forth the stack to the at least one pair of moving rollers provided above, and then causes the at least one pair of moving rollers to rotate while sandwiching therebetween the folding line to form a complete folding line and at the same time send forth the stack of sheets in parallel with the axes of the initial folding rollers.

When a print product is a newspaper of a blanket size, a method of producing a print product disclosed in Patent Document 4 defines a blanket-size newspaper such that the widthwise direction of the newspaper is made parallel to the widthwise direction of a continuous paper and two pages are aligned in the widthwise direction of the continuous paper, prints repeatedly a predetermined number of the blanket-size newspaper pages lined in the continuity direction of the continuous paper by a digital printing device, sends forth the continuous paper to the downstream side and at the same time cuts the continuous paper in parallel with the widthwise direction of the continuous paper in alignment with the printed newspaper page in a length dimension of the blanket-size newspaper, scores the cut sheets at their widthwise center, moreover, stacks the scored sheets by making the sheets sequentially straddle a collation chain such that their scored folding line aligns with the spine of the collation chain, folds the sheets into two by causing a discharging member to project the folding line of the plurality of sheets straddling the collation chain while being stacked into between carrying conveyors facing each other, and guides the twofold sheets to a quarter folding mechanism, which then produces the sheets into a fourfold blanket-size newspaper. When a print product is a newspaper of a tabloid size which is half the blanket size, a method for producing a print product disclosed in Patent Document 4 defines a newspaper of a tabloid size such that the lengthwise direction of the newspaper is made parallel to the widthwise direction of a continuous paper and two pages are aligned in the continuity direction of the continuous paper, sends forth to the downstream side the continuous paper on which a predetermined number of the tabloid-size newspaper pages are printed repeatedly lined in the continuity direction of the continuous paper by the digital printing device with two pages of the newspaper arranged in the widthwise direction of the continuous paper and at the same time cuts the continuous paper in parallel with the widthwise direction of the continuous paper in alignment with the printed newspaper page at lengths double the width dimension of the tabloid-size newspaper, scores the cut sheets at their widthwise center, stacks the scored sheets by making the sheets sequentially straddle the collation chain such that their scored folding line aligns with the spine of the collation chain, folds the sheets into two by causing the discharging member to project the folding line of the plurality of sheets straddling the collation chain while being stacked into between the carrying conveyors facing each other, guides the twofold sheets to a cutting/sewing station, cuts the twofold sheets at the vicinity of the scored folding line along the folding line to produce them into a stack of cut sheets in each of which there are arranged two pages of the tabloid-size newspaper of which width direction is parallel with the cutting edge, and if necessary, sews the stack at its center in the direction in which the two pages of the newspaper are arranged such that the stack is sewn along a direction orthogonal to the cutting edge, then guides the stack to the quarter folding mechanism, which quarter-folds the stack at its center in the alignment direction of two pages of the newspaper along the direction orthogonal to the cutting edge to produce it into a twofold tabloid-size newspaper.

In other words, Patent Document 4 discloses a method of producing a fourfold print product having a print surface aligned with a width dimension of a continuous paper, and a method of producing a twofold print product having a print surface aligned with a dimension which is half of a width dimension of a continuous paper.

[Patent Document 1] JP 2002-193545 A
[Patent Document 2] JP 2003-341927 A
[Patent Document 3] JP 2007-15859 A
[Patent Document 4] JP 2007-76923 A

SUMMARY OF THE INVENTION

Such a method of producing a print product as represented by Patent Documents 1 to 4 identified above which is based on a digital printing manner proposed so far cuts a continuous paper on which printing has been performed into individual sheets, carries them, stacks them in their original flat-sheet state or with fold valleys of fold mountains of a first fold overlapped after giving them a first fold, and guides them in an overlapped state to a quarter folding mechanism to quarter-fold them, thereby producing a quarter-folded print product. However, when the print product is for example a newspaper, such a method of producing a print product requires an unprecedentedly large process space for carrying, stacking, and folding printed sheets of the newspaper, which have an area by far larger than that of conventional mass-produced digital print products such as direct mail or commercial pamphlets. The mechanisms for processing subsequent to printing inevitably become large-scaled and require a large installation area, which is extremely out of balance with a digital printing mechanism having a simple and compact structure compared to a conventional printing mechanism using plates.

Meanwhile, as digital printing comes to target various print products, papers used for printing also become diverse. Therefore, in production of a print product using relatively thin and low-rigidity paper, when carrying the paper, it is necessary to control any moves of the edges of the paper across approximately the entire width so that the edges of the paper do not become recurvate or bent due to air resistance. It is also required to finish the manufacture and assembly of any members that contact the paper with high precision so that the paper is not wrinkled or torn due to any unnecessary force that might act on the paper when action of the carrying force on the paper becomes imbalanced, such a requirement causing production costs to increase. Furthermore, when stacking, it is extremely difficult to stack the sheets in a way to make the four sides meet their corresponding sides, because, even if edges of the sheets are tapped for sheet-alignment either or both during free fall or after fall of the sheets, a whole sheet does not move uniformly in a direction of the tapping force because warping occurs in the sheet or a contact friction force acts on the sheet.

The present invention was made in view of the above problems of the conventional techniques, and an object of the present invention is to provide a method of producing a print product and a print product production device which can make the processing mechanisms after digital printing as small-scale as possible and which can quite easily obtain a favorably stacked state of sheets having four sides of sheets aligned even in print product production using sheets of relatively low rigidity.

The present invention aims for accomplishing the above object by the configuration described in the claims. The present invention is characterized by cutting a continuous paper to make paper sheets and at the same time overlapping these paper sheets, moving these overlapped paper sheets from an overlapping region and at the same time performing a first fold of these overlapped paper sheets to form a section, and then forming a section block by at least one of these sections. In more detail, the present invention is characterized by cutting a printing-completed continuous paper into a paper sheet and folding the paper sheet in two to form a section, and forming a section block by at least one of these sections, and, moreover, is characterized by cutting a printing-completed continuous paper into a paper sheet and overlapping this paper sheet and folding this paper sheet in two to form a section, and forming a section block by at least one of these sections.

Furthermore, the present invention is characterized in that an overlap number of the paper sheet configuring the section is specifiable, and is characterized by cutting the printing-completed continuous paper into a paper sheet and overlapping this paper sheet in an amount of the specified number and folding this paper sheet in two to form a section, and forming a section block by at least one of these sections.

A method of producing a print product and a print product production device according to the present invention cuts a continuous paper on which digital printing has been performed to make paper sheets and at the same time overlaps these paper sheets, moves these overlapped paper sheets from an overlapping region and at the same time performs a first fold of these overlapped sheets to form a section. Hence, process space after digital printing when producing the print product can be significantly reduced in scale compared to conventional technology, thereby enabling the installation area of the print product production device to be set to a minimum necessary.

Moreover, as previously described, the method of producing a print product and the print product production device according to the present invention cuts the continuous paper to make paper sheets and at the same time overlaps these paper sheets, hence eradicates disadvantages occurring when moving the paper sheets and when overlapping the moved paper sheets, in the case that, after cutting the continuous paper to make the paper sheets, these paper sheets are carried and moved to be overlapped, as in the conventional technology, and thereby makes it possible to quite easily obtain a favorably stacked state of sheets having four sides of sheets aligned.

Furthermore, the method of producing a print product and the print product production device according to the present invention forms a section which has an area that is half and has increased rigidity compared to a paper sheet prior to folding by performing the first fold, and forms a section block from these sections, that is, has the section block formed by overlapping of a plurality of sections, hence, even if processing for that overlapping is a processing for carrying then overlapping, eradicates disadvantages occurring when moving the paper sheets and when overlapping the moved paper sheets, in the case of carrying and moving paper sheets of large area to be overlapped, as in the conventional technology, and thereby makes it possible to quite easily obtain a favorably stacked state of sheets (section) having four sides of sheets aligned.

Therefore, the method of producing a print product and the print product production device according to the present invention in which a print product is formed by folding in two and gathering this section block enables a print product to be obtained which has an extremely good external appearance having four sides of sheets aligned.

DETAILED DESCRIPTION OF THE INVENTION

Preferred embodiments for carrying out the present invention are described below with reference to the drawings. The following embodiments are not intended to limit the inventions set forth in the claims, and the combinations of features described in the embodiments are not all necessarily indispensable for the means for solving the problem by the invention.

Figure 1:
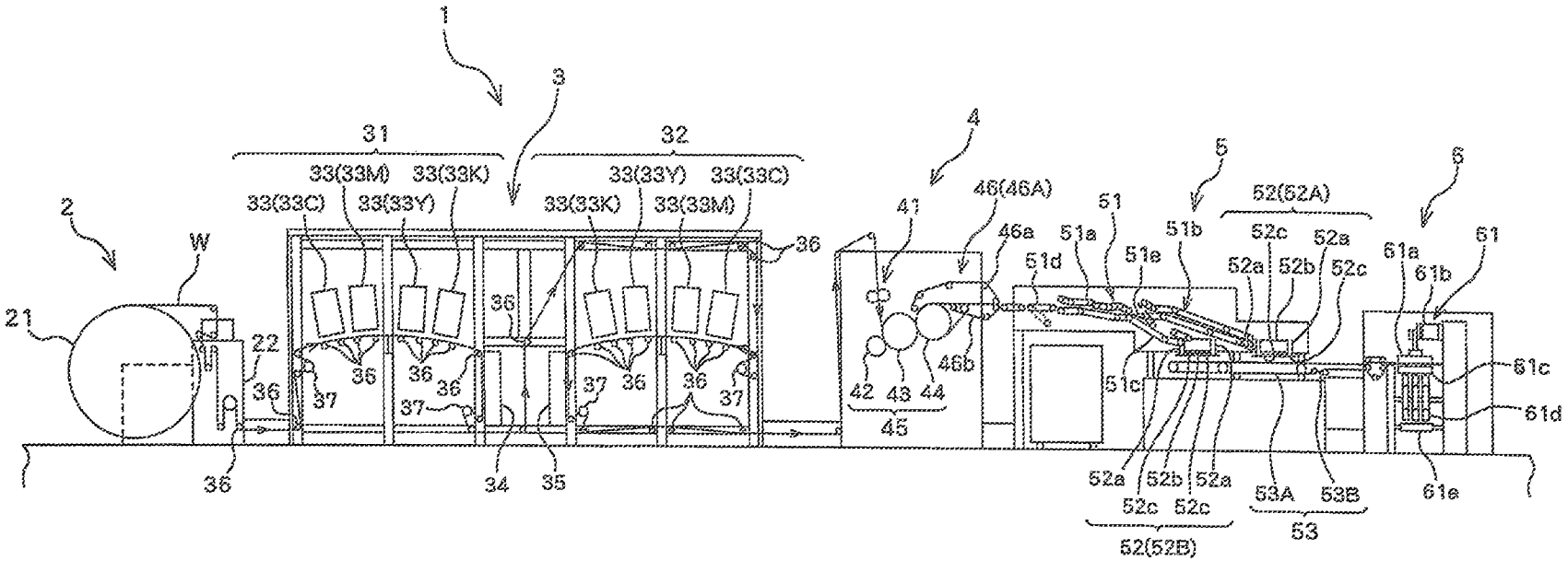
FIG. 1 is an elevation view skeleton diagram showing an overall configuration of a print product production device capable of carrying out a method of producing a print product according to the present invention.
Figure 2:
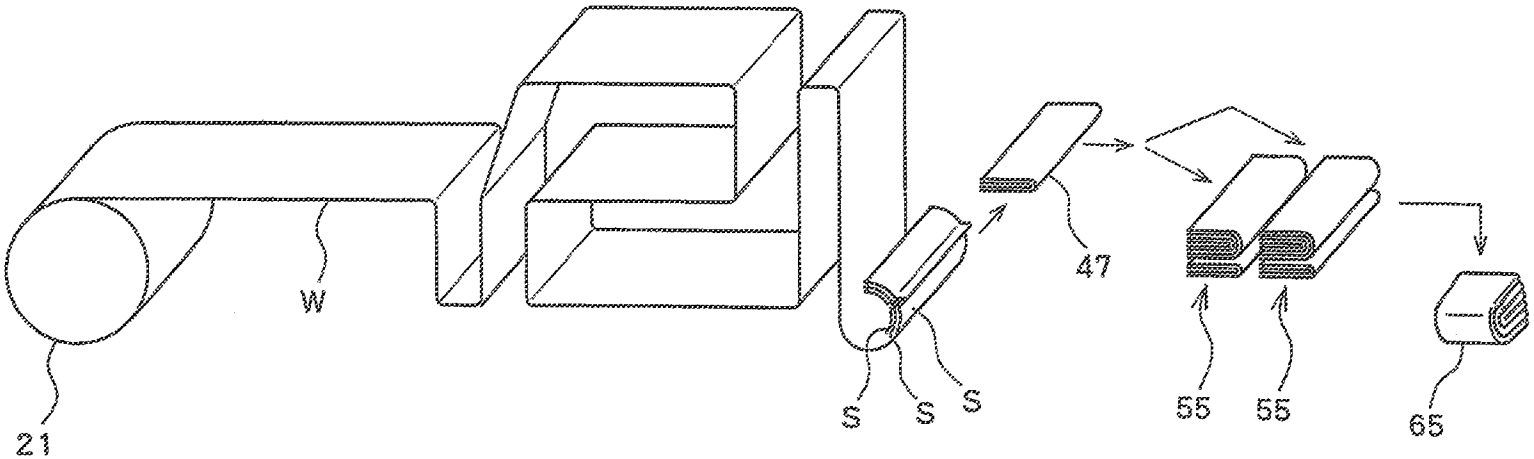
FIG. 2 is a perspective view showing a process by which a print product is formed from a continuous paper by the print product production device shown in FIG. 1, the process being shown in terms of form of paper.
Figure 3:
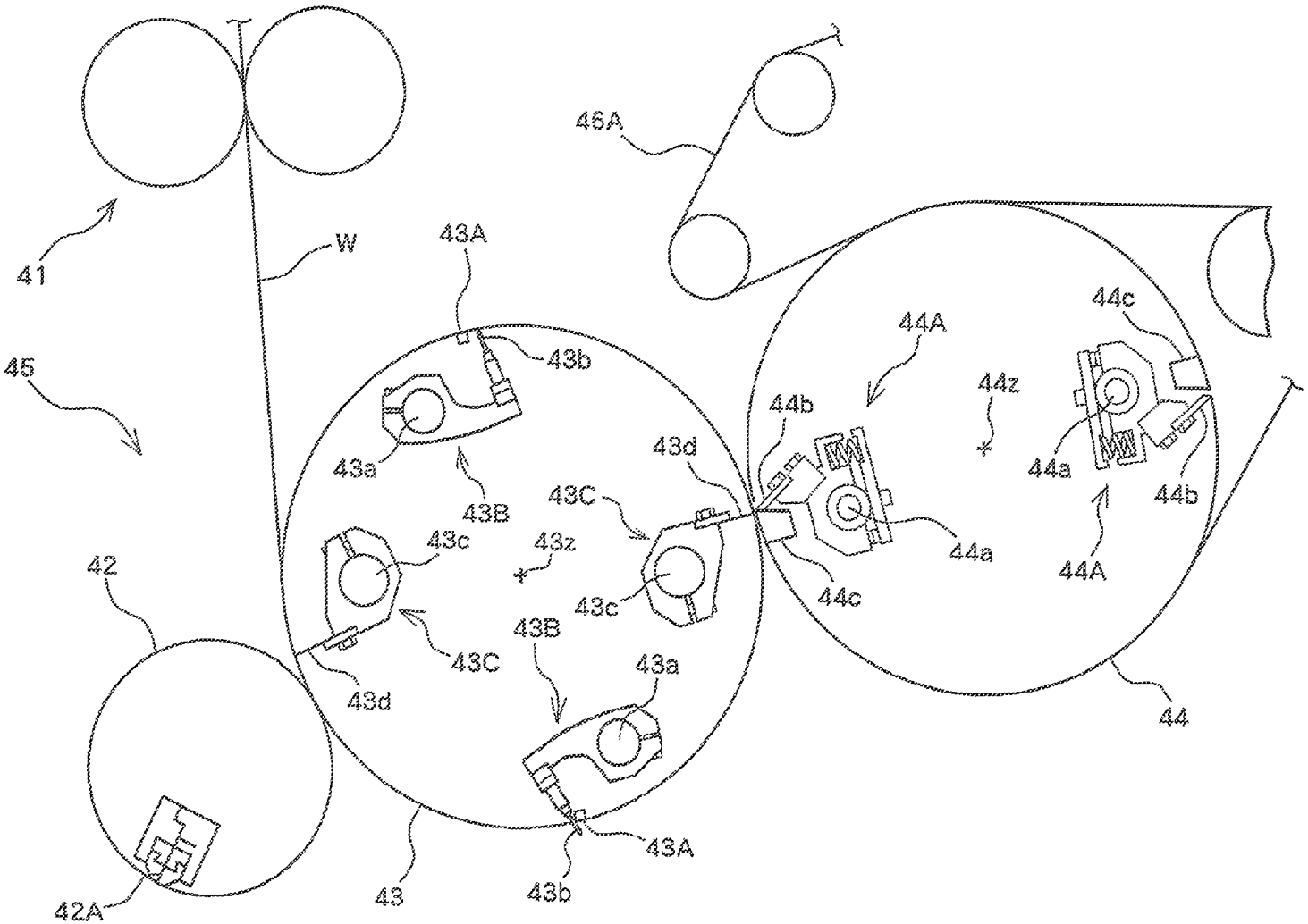
FIG. 3 is an elevation view skeleton diagram showing main parts of a section formation unit disposed in the print product production device according to the present embodiment.
Figure 4:
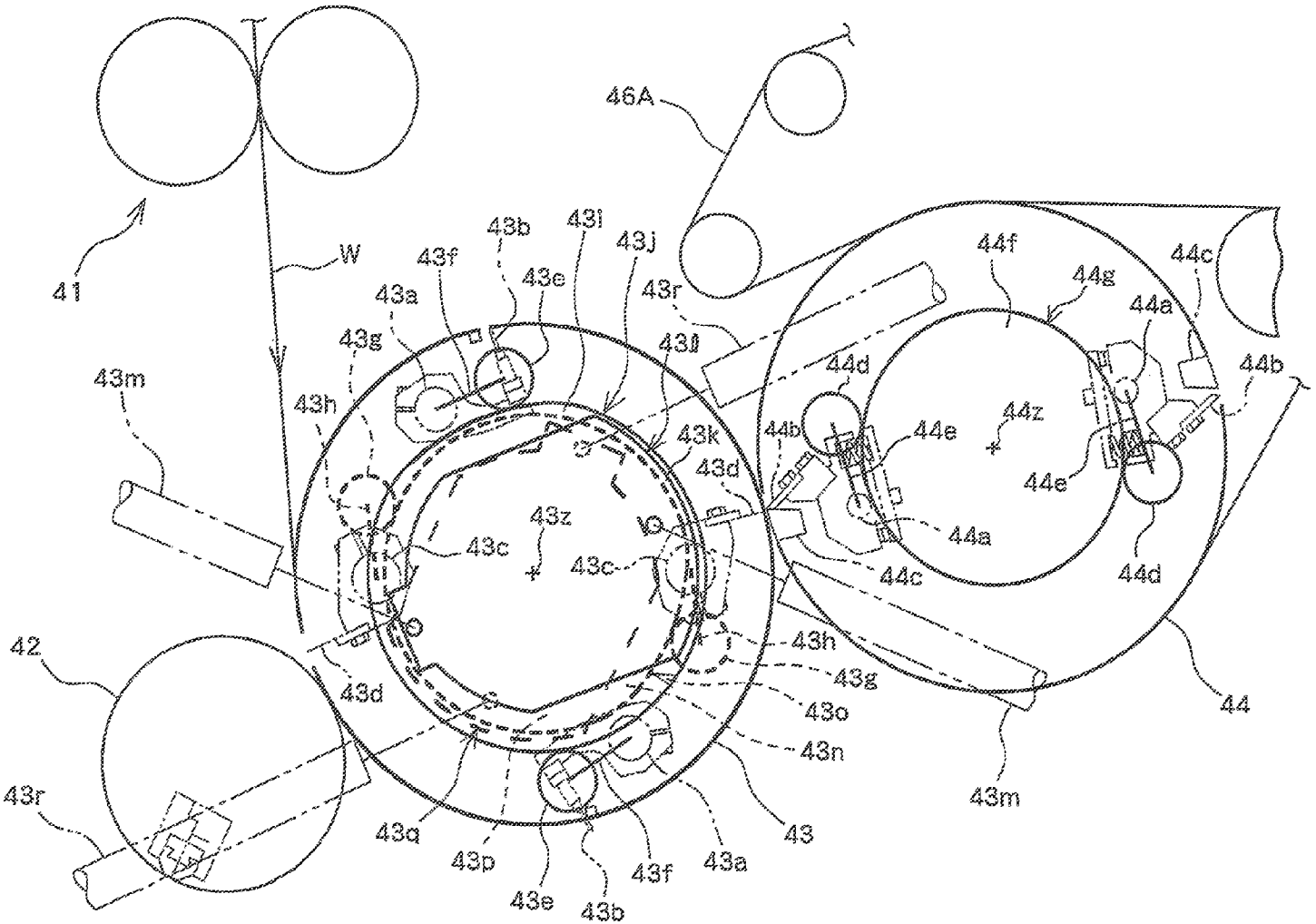
FIG. 4 is an elevation view skeleton diagram showing main parts of a cam mechanism for driving the main parts of the section formation unit according to the present embodiment.

FIG. 1 is an elevation view skeleton diagram showing an overall configuration of a print product production device 1 capable of carrying out a method of producing a print product according to the present invention. FIG. 2 is a perspective view showing a process by which a print product 65 is formed from a continuous paper W by the print product production device 1 shown in FIG. 1, the process being shown in terms of form of paper. FIG. 3 is an elevation view skeleton diagram showing main parts of a section formation unit 4 disposed in the print product production device 1 according to the present embodiment. FIG. 4 is an elevation view skeleton diagram showing an outline of a cam mechanism for driving the main parts of the section formation unit 4 according to the present embodiment.

The print product production device 1 comprises at least a continuous paper supply unit 2 a digital printing unit 3, the section formation unit 4, a section block formation unit 5, and a section block folding-in-two unit 6, and in the embodiment shown in FIG. 1, the continuous paper supply unit 2, the digital printing unit 3, the section formation unit 4, the section block formation unit 5, and the section block folding-in-two unit 6 are disposed sequentially in series from an upstream side.

The continuous paper supply unit 2 is able to support a paper roll 21 having the continuous paper W formed in a roll shape, in a rotatable and rotation-damping-capable manner. In addition, the continuous paper supply unit 2 comprises an in-feed mechanism 22 capable of sending forth the continuous paper W to downstream side units while adjusting running tension of the continuous paper W.

The digital printing unit comprises a first printing mechanism area 31 for printing on one side of the continuous paper W and a second printing mechanism area 32 for printing on the other side of the continuous paper W. In the embodiment shown in the drawings, the digital printing unit 3 is a single pass ink jet printing unit which includes ink jet printing mechanisms 33 in both the first printing mechanism area 31 and the second printing mechanism area 32, each of the ink jet printing mechanisms 33 comprising a line head type ink jet head including an ink discharge region compatible with a width of the continuous paper W, and both the first printing mechanism area 31 and the second printing mechanism area 32 each comprise, sequentially from the upstream side in a running direction of the continuous paper W, a cyan ink-dedicated ink jet printing mechanism 33C, a magenta ink-dedicated ink jet printing mechanism 33M, a yellow ink-dedicated ink jet printing mechanism 33Y, and a black ink-dedicated ink jet printing mechanism 33K. Note that the first printing mechanism area 31 and the second printing mechanism area 32 need only comprise at least one ink jet printing mechanism 33, and may comprise more than four ink jet printing mechanisms 33. In addition, the digital printing unit 3 shown in FIG. 1 includes, between the first printing mechanism area 31 and the second printing mechanism area 32, a first drying device 34 facing a print surface of the continuous paper W printed by the first printing mechanism area 31 and configured to dry this print surface a second drying device 35 facing a print surface of the continuous paper W printed by the second printing mechanism area 32 and configured to dry this print surface.

Furthermore, the digital printing unit 3 shown in 1 has a running path of the continuous paper W formed by guide members 36 which are for example guide rollers or the like, such that a surface of the continuous paper W is capable of running at a lower side of the first printing mechanism area 31 and the second printing mechanism area 32, that is, at a downward position separated by an amount of an appropriate predetermined distance from an ink discharge nozzle of the ink jet head of the cyan ink-dedicated ink jet printing mechanism 33C, the magenta ink-dedicated ink jet printing mechanism 33M, the yellow ink-dedicated ink jet printing mechanism 33Y, and the black ink-dedicated ink jet printing mechanism 33K, respectively, in a state of facing the ink discharge nozzle. This running path goes through, sequentially, the first printing mechanism area 31, the first drying device 34, the second printing mechanism area 32, and the second drying device 35. In addition, provided to said running path at an appropriate position is a drag roller mechanism 37 that drags and sends forth the continuous paper W.

The section formation unit 4 comprises a drag roller mechanism 41 to draw the printed and dried continuous paper W into the section formation unit 4. Provided at a downstream side of the drag roller mechanism 41 is a jaw folding mechanism 45 including a cutting cylinder 42, a folding cylinder 43, and a jaw cylinder 44 which are disposed in state of having their outer circumferential surfaces in proximity to each other and which are driven to rotate around axis lines that are perpendicular to the running direction of the continuous paper W and parallel to the surface of this running continuous paper W. Provided at a downstream side of the jaw folding mechanism 45 is a delivery mechanism 46 for sending forth to the downstream side a section 47 formed by the jaw folding mechanism 45.

The cutting cylinder 42 includes a cutting blade 42A at its outer circumferential surface. In the embodiment shown in the drawings, an outer circumferential dimension of the cutting cylinder 42 is substantially equal to a length that the continuous paper W is cut.

The folding cylinder 43 has an outer circumferential dimension which is approximately twice that of the cutting cylinder 42, and includes, at two places bisecting its outer circumferential surface, a cutting blade receiver 43A capable of receiving a blade edge of a cutting blade 42A. Moreover, provided in a vicinity of each cutting blade receiver 43A is a paper edge holding mechanism 43B. Furthermore, provided at substantially equally divided positions between disposal positions of the paper edge holding mechanisms 43B in the circumferential direction of the folding cylinder 43 are two folding blade mechanisms 43C.

The paper edge holding mechanism 43B includes, on a support shaft 43*a* provided to the folding cylinder 43 so as to be parallel to an axis direction of the folding cylinder 43, a plurality of paper holding pins 43*b* attached at appropriate intervals in a direction perpendicular to a paper surface in FIG. 3, and is provided such that, in accordance with a reciprocating angular displacement of the support shaft 43*a*, a point of the paper holding pin 43*b* is projectable and retractable from an outer circumferential surface on an upstream side of a vicinity of the cutting blade receiver 43A in the outer circumferential surface of the folding cylinder 43 in the rotational direction of the folding cylinder 43. The folding blade mechanism 43C includes a folding blade 43*d* attached to another support shaft 43*c* provided to the folding cylinder 43 so as to be parallel to the axis direction of the folding cylinder 43, and is provided such that, in accordance with a reciprocating angular displacement of the support shaft 43*c*, a point of the folding blade 43*d* is projectable and retractable at substantially equally divided positions between retraction sites of points of the paper holding pins 43*b* in the outer circumferential surface of the folding cylinder 43.

At least one end of the support shaft 43*a* of the paper edge holding mechanism 43B projects outwardly from one side surface of the folding cylinder 43, and to this one end, two arms 43*f* and 43*f* having a cam follower 43*e* rotatably attached to a free end side thereof each have a base end side fixed with an identical phase at appropriate intervals in the axis direction (direction perpendicular to a paper surface in FIG. 4). Moreover, at least another end of the support shaft 43*c* of the folding blade mechanism 43C projects outwardly from the other side surface of the folding cylinder 43 which is an opposite side to the one side surface of the folding cylinder 43 from which the support shaft 43*a* of the paper edge holding mechanism 43B projects, and to this other end, two arms 43*h* and 43*h* having a cam follower 43*g* rotatably attached to a free end side thereof each have a base end side fixed with an identical phase at appropriate intervals in the axis direction (direction perpendicular to a paper surface in FIG. 4).

Meanwhile, a paper holding pin drive cam 43*i* is provided fixed to a frame (not shown in the drawings) that rotatably supports the folding cylinder 43, at a position facing the one side surface of the folding cylinder 43. The paper holding pin drive cam 43*i* includes an endless cam surface 43*j* in which a distance from an axis line 43*z* of the folding cylinder 43 at which the paper holding pin 43*b* is to be operated changes in a predetermined state, and this endless cam surface 43*j* is provided disposed at a position to be rotatable and contacted by the outer circumferential surface of the cam follower 43*e* attached to the free end side of one of the arms 43*f* fixed to the one end of the support shaft 43*a*.

Furthermore, provided at a position adjacent to the paper holding pin drive cam 43*i* is a masking cam 43*k*. The masking cam 43*k* includes at least a mask cam surface 43*l* that invalidates a region (small diameter region) for retracting the paper holding pin 43*b* from the outer circumferential surface of the folding cylinder 43 in the endless cam surface 43*j* of the paper holding pin drive cam 43*i*. Moreover, this mask cam surface 43*l* is capable of displacement between a state invalidating the small diameter region in the endless cam surface 43*j* of the paper holding pin drive cam 43*i* and a state not invalidating the small diameter region, and, when the mask cam surface 43*l* of the masking cam 43*k* is in a state of at least invalidating the small diameter region in the endless cam surface 43*l* of the paper holding pin drive cam 43*i*, this mask cam surface 43*l* is provided disposed at a position to be rotatable and contacted by the outer circumferential surface of the cam follower 43*e* attached to the free end side of the other of the arms 43*f* fixed to the one end of the support shaft 43*a*.

Note that a displacement means of the masking cam 43*k* may be, for example, hydraulic actuated cylinders 43*m* and 43*m* attached to the frame, and is provided capable of operation by an operation signal outputted with an appropriate timing that has been pre-specified and set. In the embodiment shown in FIG. 3, when an output rod of the hydraulic actuated cylinders 43*m* and 43*m* extends, the masking cam 43*k* undergoes angular displacement around the axis line 43*z* of the folding cylinder 43, and the mask cam surface 43*l* moves to a position overlapping the small diameter region in the endless cam surface 43*j* of the paper holding pin drive cam 43*i*. When the output rod of the hydraulic actuated cylinders 43*m* and 43*m* retracts, the masking cam 43*k* undergoes angular displacement around the axis line 43*z* of the folding cylinder 43, and the mask cam surface 43*l* moves to a position, shown in the drawings, not overlapping the small diameter region in the endless cam surface 43*j* of the paper holding pin drive cam 43*i*. Note that, in FIG. 4, in order to facilitate understanding of the paper holding pin drive cam 43*i* and the masking cam 43*k*, a distance from the axis line 43*z* of the folding cylinder 43 of a region (large diameter region) for projecting the paper holding pin 43*b* from the outer circumferential surface of the folding cylinder 43 in the endless cam surface 43*j* of the paper holding pin drive cam 43*i*, and a distance from the axis line 43*z* of the folding cylinder 43 of the mask cam surface 43*l* of the masking cam 43*k* are, for convenience, shown to differ. However, in reality, both distances are provided to be equal.

In addition, a folding blade drive cam 43*n* is provided fixed to a frame (not shown in the drawings) that rotatably supports the folding cylinder 43, at a position facing the other side surface of the folding cylinder 43. The folding blade drive cam 43*n* includes an endless cam surface 43*o* in which a distance from the axis line 43*z* of the folding cylinder 43 at which the folding blade 43*d* is to be operated changes in a predetermined state, and this endless cam surface 43*o* is provided disposed at a position to be rotatable and contacted by the outer circumferential surface of the cam follower 43*g* attached to the free end side of one of the arms 43*h* fixed to the other end of the support shaft 43*c*.

Furthermore, provided at a position adjacent to the folding blade drive cam 43*n* is a masking cam 43*p*. The masking cam 43*p* includes at least a mask cam surface 43*q* that invalidates a region (small diameter region) for projecting the folding blade 43*d* from the outer circumferential surface of the folding cylinder 43 in the endless cam surface 43*o* of the folding blade drive cam 43*n*. Moreover, this mask cam surface 43*q* is capable of displacement between a state invalidating the small diameter region in the endless cam surface 43*o* of the folding blade drive cam 43*n* and a state not invalidating the small diameter region, and, when the mask cam surface 43*q* of the masking cam 43*p* is in a state of at least invalidating the small diameter region in the endless cam surface 43*o* of the folding blade drive cam 43*n*, this mask cam surface 43*q* is provided disposed at a position to be rotatable and contacted by the outer circumferential surface of the cam follower 43*g* attached to the free end side of the other of the arms 43*h* fixed to the other end of the support shaft 43*c*.

Note that a displacement means of the masking cam 43*p* may be, for example, hydraulic actuated cylinders 43*r* and 43*r* attached to the frame, and is provided capable of operation by an operation signal outputted with an appropriate timing that has been pre-specified and set. In the embodiment shown in FIG. 3, when an output rod of the hydraulic actuated cylinders 43*r* and 43*r* extends, the masking cam 43*p* undergoes angular displacement around the axis line 43*z* of the folding cylinder 43, and the mask cam surface 43*q* moves to a position overlapping the small diameter region in the endless cam surface 43*o* of the folding blade drive cam 43*n*. When the output rod of the hydraulic actuated cylinders 43*r* and 43*r* retracts, the masking cam 43*p* undergoes angular displacement around the axis line 43*z* of the folding cylinder 43, and the mask cam surface 43*q* moves to a position, shown in the drawings, not overlapping the small diameter region in the endless cam surface 43*o* of the folding blade drive cam 43*n*. Note that, in FIG. 3, in order to facilitate understanding of the folding blade drive cam 43*n* and the masking cam 43*p*, a distance from the axis line 43*z* of the folding cylinder 43 of a region (large diameter region) for retracting the folding blade 43*d* from the outer circumferential surface of the folding cylinder 43 in the endless cam surface 43*o* of the folding blade drive cam 43*n*, and a distance from the axis line 43*z* of the folding cylinder 43 of the mask cam surface 43*q* of the masking cam 43*p* are, for convenience, shown to differ. However, in reality, both distances are provided to be equal.

The jaw cylinder 44 has an outer circumferential dimension which is substantially the same as that of the folding cylinder 43, and includes, at two places bisecting its outer circumferential surface, a jaw mechanism 44A.

The jaw mechanism 44A includes a plate member 44*h* attached to a support shaft 44*a* provided to the jaw cylinder 44 so as to be parallel to an axis direction of the jaw cylinder 44, and is provided so as to be adjacency-or-contact-capable and separation-capable with respect to a block member 44*c* provided fixed to the jaw cylinder 44 facing the plate member 44*b*, in accordance with a reciprocating angular displacement of the support shaft 44*a*. Moreover, as a result of the plate member 44*b* being adjacent to or contacting the block member 43*c*, a middle part in a cutting length direction of a single paper sheet S or plurality of paper sheets S formed by cutting the continuous paper W and caused to protrude from the outer circumferential surface of the folding cylinder 43 by the folding blade 43*d* of the folding cylinder 43 is sandwiched and received, and the paper sheets S are folded in two at their middle part to form a section 47 in the embodiment shown in the drawings, the jaw cylinder 44 is capable of receiving from the folding cylinder 43 two in succession of the single paper sheet S or plurality of paper sheets S of identical configuration formed by cutting the continuous paper W, and the jaw cylinder 44 that has received two in succession of the paper sheets S of identical configuration is able to release two sections 47 of identical configuration toward a delivery mechanism 46 to be described later, while making one revolution after receiving the paper sheets S.

At least one end of the support shaft 44*a* of the law mechanism 44A projects outwardly from one side surface of the jaw cylinder 44, and to this one end, an arm 44*e* having a cam follower 44*d* rotatably attached to a free end side thereof has a base end side fixed.

Meanwhile, a plate member drive cam 44*f* is provided fixed to a frame (not shown in the drawings) that rotatably supports the jaw cylinder 44, at a position facing the one side surface of the jaw cylinder 44. The plate member drive cam 44*f* includes an endless cam surface 44*g* in which a distance from an axis line 44*z* of the jaw cylinder 44 at which the plate member 44*b* is to be operated changes in a predetermined state, and this endless cam surface 44*g* is provided disposed at a position to be rotatable and contacted by the outer circumferential surface of the cam follower 44*d* attached to the free end side of the arm 44*e* fixed to the one end of the support shaft 44*a*.

Note that the plate member 44*b* need only have a width in the axis direction of the jaw cylinder 44 that is at least slightly less than a width dimension of the paper sheet S gripped by the jaw mechanism 44A, may be provided divided or in an integrated manner, and, is normally provided having at least 2 leading edge side appropriately divided.

The delivery mechanism comprises a delivery conveyor 46A. The delivery conveyor 46A includes an upper conveyor 46*a* and a lower conveyor 46*b* having carrying surfaces that face each other and are displaced in the same direction, and carries a section 47 released by the jaw mechanism 44A of the jaw cylinder 44 sandwiched between the upper conveyor 46*a* and the lower conveyor 46*b*, to send forth the section 47 to the downstream side.

The section block formation unit 5 comprises a carrying mechanism 51 for receiving and carrying the section 47 formed in the section formation unit 4, a section block formation mechanism 52 for stacking a previously-specified set quantity of sections 47, and a delivery mechanism 53 for sending forth a section block 55 that is formed to the downstream side.

The carrying mechanism 51 includes an upstream carrying conveyor 51*a* for receiving and carrying the section 47 sent forth from the delivery mechanism 46 of the section formation unit 4, and a first downstream carrying conveyor 51*b* and second downstream carrying conveyor 51*c* provided branching at a downstream end of this upstream carrying conveyor 51*a*. Moreover, an upstream portion of the upstream carrying conveyor 51*a* is provided with a waste release means 51*d* for discharging a section 47 having some kind of defect such as a printing defect or folding defect. In addition, an upstream end of the first downstream carrying conveyor 51*b* is provided with a switching means 51*e* for guiding the section 47 carried by the upstream carrying conveyor 51*a* into the first downstream carrying conveyor 51*b*. Furthermore, the carrying mechanism 51 is provided such that the switching means 51*e* operates such that the first downstream carrying conveyor 51*b* and second downstream carrying conveyor 51*c* respectively carry one each of two sections 47 released in succession by the law cylinder 44 of the section formation unit 4. Moreover, the first downstream carrying conveyor 51*b* and second downstream carrying conveyor 51*c* have their carrying speeds controlled such that the sections 47 they both carry reach almost simultaneously a first section block formation mechanism 52A or a second section block formation mechanism 52B to be described later which are provided corresponding to, respectively, the first downstream carrying conveyor 51*b* and second downstream carrying conveyor 51*c*.

The section block formation mechanism 52 has the first section block formation mechanism 52A provided to a downstream side of the first downstream carrying conveyor 51*b* and the second section block formation mechanism 52B provided to the downstream side of the second downstream carrying conveyor 51*c*. The first section block formation mechanism 52A and the second section block formation mechanism 52B each includes a rectangular space having a horizontal bottom surface and restricted by restricting members 52*a*, 52*b*, and 52*c* for restricting each of at least three surfaces adjacent to each other. Moreover, the restricting member 52*c* for restricting the horizontal bottom surface is movably provided between a restricted position restricting the horizontal bottom surface and an open position opening the horizontal bottom surface. A movement drive means (not shown in FIG. 1) of the restricting member 52*c* may be an appropriate means, for example, a hydraulic actuated cylinder, which operates by an operation signal outputted with an appropriate timing that has been pre-specified and set. In the embodiment shown in the drawings, the first section block formation mechanism 52A and the second section block formation mechanism 52B are provided along a delivery direction of a delivery mechanism 53 to be described later, hence operation of the movement drive means of the restricting member 52*c* is provided to be performed substantially simultaneously in the first section block formation mechanism 52A and the second section block formation mechanism 52B.

The delivery mechanism 53 comprises a carrying conveyor 53A that operates intermittently. The carrying conveyor 53A is provided to receive in a stopped state on its carrying surface the section block 55 released by the first section block formation mechanism 52A and the second section block formation mechanism 52B opening their horizontal bottom surfaces, and, after receiving the section block 55, to operate with an appropriate timing to carry the received section block 55 to the downstream side. Moreover, a downstream side portion of the delivery mechanism 53 is configured as a waiting conveyor 53B. The waiting conveyor 53B is provided to stop and hold in waiting a section block 55 formed by the second section block formation mechanism 52B while a section block 55 formed by the first section block formation mechanism 52A is being folded in two by the section block folding-in-two unit 6 to be described later.

The section block folding-in-two unit 6 may for example comprise a quarter folding mechanism 61 as in the embodiments shown in the drawings. The quarter folding mechanism 61 includes a quarter folding blade 61*a*, a drive means 61*b* of the quarter folding blade 61*a*, a folding roller pair 61*c*, a delivery fan 61*d*, and a carry-out conveyor 61*e*. The quarter folding mechanism 61 is provided to operate with an appropriate timing after the section block 55 sent from the section block formation unit 5 has reached a certain quarter folding position.

Next, production of a print product by the print product production device 1 configured as described above is described.

The continuous paper W drawn from the paper roll 21 supported by the continuous paper supply unit 2 has its running tension adjusted by a tension adjusting means provided to the in-feed mechanism 22 to be sent to the digital printing unit 3. The continuous paper W sent to the digital printing unit 3 is first guided, in accordance with the running path formed by the guide members 36, to below the ink jet printing mechanism 33, that is, sequentially to below the cyan ink-dedicated ink jet printing mechanism 33C, the magenta ink-dedicated ink jet printing mechanism 33M, the yellow ink-dedicated ink jet printing mechanism 33Y, and the black ink-dedicated ink jet printing mechanism 33K, whereby printing by cyan, magenta, yellow, and black inks are performed on one side of the continuous paper W.

The continuous paper W that has undergone printing of one side is next guided to the first drying device 34 where drying of the one side printed in the first printing mechanism area 31 is performed.

Next, the continuous paper W is guided above the second printing mechanism area 32 to go past the four ink jet printing mechanisms 33 provided in the second printing mechanism area 32, and is then guided sequentially from an opposite side to below the four ink jet printing mechanisms 33 of the second printing mechanism area 32, that is, to below the cyan ink-dedicated ink jet printing mechanism 33C, the magenta ink-dedicated ink jet printing mechanism 33M, the yellow ink-dedicated ink jet printing mechanism 33Y, and the black ink-dedicated ink jet printing mechanism 33K. Due to such guiding, the continuous paper N is turned over, whereby the other side of the continuous paper N faces the ink discharge nozzle of the four ink jet printing mechanisms 33 of the second printing mechanism area 32 undergo printing by cyan, magenta, yellow, and black inks.

The continuous paper W that has undergone printing of the other side is next guided to the second drying device 35 where drying of the other side printed in the second printing mechanism area 32 is performed. Running of the continuous paper W inside the digital printing unit 3 is performed smoothly by traction of the continuous paper W due to the drag roller mechanisms 37 provided at key places in the digital printing unit 3.

The continuous paper W that has passed the second drying device 35 is guided next to the section formation unit 4. In the section formation unit 4, the drag roller mechanism 41 pulls in the continuous paper W and sends it to between the cutting cylinder 42 and the folding cylinder 43.

In the section formation unit 4, the cutting cylinder 42, the folding cylinder 43, and the jaw cylinder 44 rotate such that circumferential surfaces adjacently facing each other are displaced in the same direction. In addition, the cutting blade 42A of the cutting cylinder 42 and the cutting blade receiver 43A of the folding cylinder 43 engage at a facing position of the cutting cylinder 42 and the folding cylinder 43, and the cutting cylinder 42, the folding cylinder 43, and the jaw cylinder rotate with an almost identical circumferential surface speed with a mutual phase that enables delivery of the paper sheet at the facing position of the folding cylinder and the jaw cylinder 44 due to the folding blade mechanism 43C of the folding cylinder 43 and the jaw mechanism 44A of the jaw cylinder 44. The continuous paper W sent to between the cutting cylinder 42 and the folding cylinder 43 is first held by the paper holding pin 43*b* due to a point side of the paper holding pin 43*b* projecting from a circumferential surface of the folding cylinder 43 piercing the continuous paper W and cut by engagement of the cutting blade 42A and the cutting blade receiver 43A at an adjacent downstream position to that held position. Then, every half revolution of folding cylinder 43, this holding of the continuous paper W due to the paper holding pin 43*b* and cutting of the continuous paper W due to engagement of the cutting blade 42A and the cutting blade receiver 43A are performed, and, every half circumferential surface of the folding cylinder 43, the sheet paper S is overlapped.

During this overlapping of the paper sheet S, the output rod of the hydraulic actuated cylinders 43*m* and 93*m* is extended, the mask cam surface 43*l* of the masking cam 43*k* coincides with a phase of the small diameter region of the endless cam surface 43*j* of the paper holding pin drive cam 43*i*, and continues to invalidate action of the small diameter region of the endless cam surface 43*j*, and the point side of the paper holding pin 43*b* does not retract from the outer circumferential surface of the folding cylinder 43. Similarly, the output rod of the hydraulic actuated cylinders 43*r* and 43*r* is extended, the mask cam surface 43*q* of the masking cam 43*p* coincides with a phase of the small diameter region of the endless cam surface 43*o* of the folding blade drive cam 43*n*, and continues to invalidate action of the small diameter region of the endless cam surface 43*o*, and the point side of the folding blade 43*d* does not project from the outer circumferential surface of the folding cylinder 43.

When the overlap number of the paper sheet S reaches a pre-specified set number, the folding cylinder 43 folding delivers the paper sheets S overlapped on its outer circumferential surface to the jaw mechanism 44A of the jaw cylinder 44. That is, when the overlap number of the paper sheet S reaches the pre-specified set number, an operation signal is outputted from a control unit not shown in the drawings. As a result, the output rod of the hydraulic actuated cylinders 43*m* and 43*m* and the hydraulic actuated cylinders 43*r* and 43*r* retracts. Retraction of the output rod of the hydraulic actuated cylinders 43*m* and 43*m* causes the masking cam 43*k* to undergo angular displacement in a clockwise direction around the axis line 43*z* of the folding cylinder 43, and the mask cam surface 43*l* to deviate from the phase of the small diameter region of the endless cam surface 43*j* of the paper holding pin drive cam 43*i* as shown in FIG. 4, thereby validating action of said small diameter region. Similarly, retraction of the output rod of the hydraulic actuated cylinders 43*r* and 43*r* causes the masking cam 43*p* to undergo angular displacement in a clockwise direction around the axis line 43*z* of the folding cylinder 43, and the mask cam surface 43*q* to deviate from the phase of the small diameter region of the endless cam surface 43*o* of the folding blade drive cam 43*n* as shown in FIG. 4, thereby validating action of said small diameter region.

When action of the small diameter region of the endless cam surface 43*j* of the paper holding pin drive cam 43*i* is validated, the outer circumferential surface of the cam follower 43*e* attached to the free end side of one of the arms 43*f* fixed to one end of the support shaft 43*a* contacts this endless cam surface 43*j* to rotate, displaces the arm 43*f* according to a change in distance of the endless cam surface 43*j* from the axis line 43*z* of the folding cylinder 43 and causes the support shaft 43*a* to undergo angular displacement via the arm 43, and, when the cam follower 43*e* passes the small diameter region of the endless cam surface 43*j*, the paper holding pin 43*b* retracts inside from the outer circumferential surface of the folding cylinder 43. When the paper holding pin 43*b* retracts inside from the outer circumferential surface of the folding cylinder 43, the paper sheet S that was held in the outer circumferential surface of the folding cylinder 43 by the paper holding pin 43*b* is released.

Moreover, when action of the small diameter region of the endless cam surface 43*o* of the folding blade drive cam 43*n* is validated, the outer circumferential surface of the cam follower 43*g* attached to the free end side of one of the arms 43*h* fixed to one end of the support shaft 43*c* contacts this endless cam surface 43*o* to rotate, displaces the arm 43*h* according to a change in distance of the endless cam surface 43*o* from the axis line 43*z* of the folding cylinder 43 and causes the support shaft 43*c* to undergo angular displacement via the arm 43*h*, and, when the cam follower 43*g* passes the small diameter region of the endless cam surface 43*o*, the leading edge side of the folding blade 43*d* projects from the outer circumferential surface of the folding cylinder 43. When the leading edge side of the folding blade 43*d* projects from the outer circumferential surface of the folding cylinder 43, the paper sheet S that was held in the outer circumferential surface of the folding cylinder 43 by the paper holding pin 43*b* is projected out to separate in a radial direction from the outer circumferential surface of the folding cylinder 43.

The paper holding pin drive cam 43*i* and the folding blade drive cam 43*n* herein are provided such that release of the paper sheet S by the paper holding pin 43*b* due to action of the small diameter region of the endless cam surface 43*j* of the paper holding pin drive cam 43*i* and separation of the paper sheet S from the circumferential surface of the folding cylinder 43 by the folding blade 43*d* due to action of the small diameter region of the endless cam surface 43*o* of the folding blade drive cam 43*n* are performed in substantially the same rotational phase of the folding cylinder 43, and a projection position of the folding blade 43*d* of the folding cylinder 43 in this rotational phase is provided to face a position at which the plate member 44*b* and the block member 44*c* of the jaw mechanism 44A are adjacent or contacting in a rotational phase of the jaw cylinder 44 to be described later. Therefore, as a result of the leading edge side of the folding blade 43*d* protruding from the outer circumferential surface of the folding cylinder 43, the middle part in a cutting length direction of the paper sheet S released from the paper holding pin 43*b* is protruded toward the jaw mechanism 44A of the jaw cylinder 44, this middle part is sandwiched by the plate member 44*b* and the block member 44*c* to be received, gripped, and folded by the jaw mechanism 44A, thereby forming the section 47 which is the paper sheet S folded in two and having a fold line formed in its central part parallel to the axis of the jaw cylinder 44.

The jaw cylinder 44 of the section formation unit 4 rotates while maintaining the previously mentioned relationships of rotation direction, rotation speed, and rotation phase with the folding cylinder 43, and in each revolution, the plate member 44*b* of the jaw mechanism 44A repeats adjacency-or-contact and separation of its leading edge side with respect to the block member 44*c* of the jaw mechanism 44A. That is, the outer circumferential surface of the cam follower 43*d* attached to the free end side of the arm 43*e* fixed to one end of the support shaft 43*a* to which the plate member 44*b* is attached contacts the endless cam surface 43*g* of the plate member drive cam 44*f* provided fixed to the frame (not shown in the drawings) facing one side surface of the jaw cylinder 44 to rotate, displaces the arm 44*e* according to a change in distance of the endless cam surface 44*g* from the axis line 44*z* of the jaw cylinder 44 and causes the support shaft 44*a* to undergo angular displacement via the arm 44*e*, and, when the cam follower 43*d* passes the large diameter region of the endless cam surface 44*a*, the leading edge side of the plate member 44*b* becomes adjacent to or contacts the block member 44*c*.

The plate member drive cam 44*f* herein is provided such that, when the large diameter region of the endless cam surface 44*g* causes the leading edge side of the plate member 44*b* to be adjacent to or contact the block member 44*c*, this adjacency-or-contact position faces the protruding position of the folding blade 43*d* of the folding cylinder 43 in the rotation phase of the jaw cylinder 44, and the adjacency-or-contact state between the leading edge side of the plate member 44*b* and the block member 44*c* is maintainable until a rotation phase is attained where the jaw cylinder 44 further rotates and the adjacency-or-contact position sufficiently reaches the delivery mechanism 46. Therefore, whenever the leading edge side of the folding blade 43*d* protrudes from the outer circumferential surface of the folding cylinder 43 and the paper sheet S released from the paper holding pin 43*b* is protruded toward the jaw mechanism 44A of the jaw cylinder 44, the paper sheet S protruded by the plate member 44*b* and the block member 44*c* is gripped and folded to form the section 47 to be delivered to the delivery mechanism 53.

The delivery mechanism 53 sandwiches the section 47 delivered from the jaw cylinder 44 between the upper conveyor 46*a* and the lower conveyor 46*b* to carry the section 47 to the downstream side while reinforcing the fold line formed by the gripping and folding. Note that it is sufficient for the overlap number of the sheet S to be pre-specified and set to an integer of one or more.

The section 47 formed in the section formation unit 4 is brought to the carrying mechanism 51 of the section block formation unit 5 by the delivery mechanism 46 of the section formation unit 4. The carrying mechanism comprises the waste release means 51*d* capable of displacement between an orientation in which the carrying surface of the conveyor in the upstream side of the upstream carrying conveyor 51*a* continues to the downstream side to form a regular carrying line and an orientation in which the carrying surface of the conveyor deviates from the regular carrying line. By adopting the orientation of this waste release means 51*d* in which the carrying surface deviates from the regular carrying line, a section (not shown in the drawings) where the number of paper sheets S generated during a print run does not reach the set number or a section (not shown in the drawings) including a defective portion generated by some kind of trouble in an upstream side unit are removed from the regular carrying line. An ordinary section 47 is carried to the downstream side by the upstream carrying conveyor 51*a* to reach a branching part of the first downstream carrying conveyor 51*b* and the second downstream carrying conveyor 51*c* provided following the upstream carrying conveyor 51*a*. The section 47 that has reached the branching part is selectively guided alternately to either the first downstream carrying conveyor 51*b* or the second downstream carrying conveyor 51*c* by a switching operation of the switching means 51*e* provided to this branching part. The first downstream carrying conveyor 51*b* and the second downstream carrying conveyor 51*c* are provided having different carrying speeds so that the section 47 carried these two conveyors can arrive at the section block formation mechanism 52 with substantially the same timing. That is, a configuration is adopted in which two sections 47 and 47 of identical configuration passed on successively from the folding cylinder 43 to the jaw cylinder 44 of the section formation unit 4 are guided one each to each of the first downstream carrying conveyor 51*b* and the second downstream carrying conveyor 51*c* by the switching operation of the switching means 51*e*, such that a timing at which the section 47 carried by the first downstream carrying conveyor 51*b* reaches the first section block formation mechanism 52A provided downstream of the first downstream carrying conveyor 51*b* and a timing at which the section 47 carried by the second downstream carrying conveyor 51*c* reaches the second section block formation mechanism 52B provided downstream of the second downstream carrying conveyor 51*c* are substantially the same. Providing such that the two sections 47 and 47 each reach the corresponding section block formation mechanisms 52 with substantially the same timing in this way is important to prevent any trouble occurring in carrying of the section block 55 to the downstream side to be described later.

The section 47 carried to the first section block formation mechanism 52A o the second section block formation mechanism 525 is formed into the section block 55 by the first section block formation mechanism 52A or the second section block formation mechanism 525, respectively. Now, formation of the section block 55 by the first section block formation mechanism 52A and the second section block formation mechanism 52E is similar, and is hence described below as formation of the section block 55 in the section block formation mechanism 52.

Each of the sections 47 that has reached the section block formation mechanism 52 is discharged to the rectangular space which has its four side surfaces restricted by the restricting members 52*a* and 52*b* and its horizontal bottom surface restricted by the restricting member 52*c*, respectively, and is stacked while having two neighboring sides aligned in this space, whereby the section block 55 is formed. When the stacked sections 47 reach the pre-specified and set number and the object section block 55 is formed, the rectangular space discharges the formed section block 55. That is, when the stacked sections 47 reach the pre-specified and set number, an operation signal is outputted from a control unit not shown in the drawings. As a result, the hydraulic actuated cylinder (riot shown in the drawings) which is the movement drive means of the restricting member 52*c* of the section block formation mechanism 52 operates, and the restricting member 52*c* is moved to the open position that opens the horizontal bottom surface of the rectangular space, whereby the section block 55 formed in the rectangular space is discharged downward.

Note that in the embodiment shown in the drawings, the first section block formation mechanism 52A and the second section block formation mechanism 52B are provided along the delivery direction of the delivery mechanism 53, hence operation of the movement drive means of the restricting member 52*c* is performed almost simultaneously in the first section block formation mechanism 52A and the second section block formation mechanism 52B. Moreover, it is sufficient for the overlap number of the section 47 to be prespecified and set to an integer of one or more.

The section block 55 discharged from the section block formation mechanism 52 is received by the carrying surface of the carrying conveyor 53A of the delivery mechanism 53 provided downward of the section block formation mechanism 52. The carrying conveyor 53A is in a stopped state when receiving the section block 55, and, after receiving the section block 55, operates with an appropriate timing to carry the received section block 55 to the downstream side.

The carrying conveyor 53A, when carrying the section block 55, carries simultaneously the two section blocks 55 and 55 discharged from the first section block formation mechanism 52A and the second section block formation mechanism 52B. However, to prevent these two section blocks 55 and 55 from being present simultaneously in the section block folding-in-two unit 6 provided at the downstream side of the section block formation unit 5, they are carried to a downstream side in the carrying direction. While the section block 55 formed in the first section block formation mechanism 52A is folded in two in the section block folding-in-two unit 6, the section block 55 formed in the second section block formation mechanism 52B is stopped and held in waiting on the carrying surface of the waiting conveyor 53B which is the downstream side portion of the delivery mechanism 53.

The section block 55 brought by the delivery mechanism 53 to the quarter folding mechanism 61 which is the section block folding-in-two unit 6 is drawn in by a drawing-in means (not shown in the drawings) of the quarter folding mechanism 61 to a certain folding-in-two position of a section block support plate (not shown in the drawings). As a result, the drive means 61*b* operates, whereby the quarter folding blade 61*a* performs a reciprocating operation in an up and down direction to strike the section block 55 drawn in to the folding-in-two position, from above, at a substantially central position in the width direction of the section block 55. The section block 55 struck by the quarter folding blade 61*a* is pushed downward from an opening provided in the section block support plate and has its width direction central position inserted between adjacent outer circumferential surfaces of the folding roller pair 61*c* that has a point of adjacency of its outer circumferential surfaces provided disposed below the opening and that has its facing circumferential surfaces displacing downward to rotate.

The section block 55 having its width direction central position inserted between the adjacent outer circumferential surfaces of the folding roller pair 61*c* is discharged downward by rotation of the folding roller pair 61*c*. At this time, the section block 55 is folded in two at its width direction central position, whereby the print product 65 having the section block 55 folded in two is formed. The print product 65 discharged downward by rotation of the folding roller pair 61*c* is received by the delivery fan 61*d* provided below the folding roller pair 61*c*, is brought to the carry-out conveyor 61*e* by rotation of the delivery fan 61*d*, transferred from the delivery fan 61*d* onto the carrying surface of the carry-out conveyor 61*e*, and carried from the print product production device 1 by the carry-out conveyor 61*e*.

That concludes description of the method of producing a print product and the print product production device according to the present invention made with reference to the embodiment shown in the drawings, the but the present invention is not limited to the previously described embodiment and includes modifications satisfying the scope of the claims.

For example, the print product production device 1 may comprise a print surface monitoring unit (not shown in the drawings) as required at an appropriate position on a downstream side of the digital printing unit. In addition, a configuration may be adopted that provides a sheet print product formation line comprising a unit group for forming a different print product to the print product 65 according to the present invention, for example, a sheet-form print product, this sheet print product formation line being provided in combination with a print product formation line according to the present invention, on a downstream side of the digital printing unit, and that provides a paper guiding path on the downstream side of the digital printing unit enabling both the print product formation line according to the present invention and the sheet print product formation line to be selectively used, thereby enabling the print product according to the present invention and the sheet print product to be selectively produced.

This invention may be utilized in production of a print product, for example, a newspaper or the like, produced by performing digital printing on a continuous paper, cutting the continuous paper into paper sheets, and folding and gathering the paper sheets after cutting.

What is claimed is:

1. A print product production device configured capable of having an overlap number of paper sheets configuring a section specified as an arbitrary overlap number of two or more, the print product production device comprising:

a continuous paper supply unit;

a digital printing unit;

a section formation unit;

a section block formation unit; and a section block folding-in-two unit, the digital printing unit being configured to perform digital printing of each surface of a print product continuously a predetermined number of two or more at a time, sequentially and repeatedly, on a continuous paper, the section formation unit comprising a jaw mechanism that includes a cutting cylinder, a folding cylinder, and a jaw cylinder and in which a circumferential length of the folding cylinder is a multiple of the predetermined number of two or more times a length for cutting the continuous paper, and the section formation unit being configured to form an identical section the predetermined number of two or more at a time, by cutting the printing-completed continuous paper to become the paper sheets, by the cutting cylinder, overlapping the paper sheets in an amount of the arbitrary overlap number, by the folding cylinder, and folding in two the paper sheets overlapped in the amount of the arbitrary overlap number, by the folding cylinder and the jaw cylinder, the section block formation unit being configured to form an identical section block the predetermined number of two or more at a time, by at least one of the sections, and the section block folding-in-two unit being configured to fold each of the predetermined number of two or more section blocks in two.

2. The print product production device according to claim 1, wherein the continuous paper supply unit, the digital printing unit, the section formation unit, the section block formation unit, and the section block folding-in-two unit are disposed in series sequentially from upstream.

3. The print product production device according to claim 1 or 2, wherein the cutting cylinder, the folding cylinder and the jaw cylinder are configured to be driven to rotate around axes that are parallel to one another, and the section formation unit is configured such that jaw folding due to cooperation of the folding cylinder and the jaw cylinder causes a first fold to be executed whereby a section is formed.

4. The print product production device according to claim 3, wherein an operation, in which jaw folding due to cooperation of the folding cylinder and the jaw cylinder causes a first fold to be executed whereby a section is formed, is configured to be executed, subsequent to a preceding operation in which the section is formed, when the folding cylinder has rotated by an amount of the same number of times as the specified arbitrary overlap number of the paper sheet configuring the section.

5. A method of producing a print product, comprising:

specifying an arbitrary overlap number of two or more paper sheets configuring a section, performing digital printing of each surface of the print product continuously a predetermined number of two or more at a time, sequentially and repeatedly, on a continuous paper;

employing a jaw mechanism that includes a cutting cylinder, a folding cylinder, and a jaw cylinder and in which a circumferential length of the folding cylinder is a multiple of the predetermined number of two or more times a length for cutting the continuous paper to form the section, forming an identical section the predetermined number of two or more at a time, by cutting the printing-completed continuous paper to become the paper sheets, by the cutting cylinder, overlapping the paper sheets in an amount of the arbitrary overlap number, by the folding cylinder, and folding in two the paper sheets overlapped in the amount of the arbitrary overlap number, by the folding cylinder and the jaw cylinder;

forming an identical section block the predetermined number of two or more at a time, by at least one of the sections; and folding each of the predetermined number of two or more section blocks in two.

* * * * *